US005268700A

United States Patent [19]

Hirotsu et al.

[11] Patent Number: 5,268,700

[45] Date of Patent: Dec. 7, 1993

[54] STRUCTURE FOR CONNECTING WINDOW GLASS ANTENNA WITH FEEDER

[75] Inventors: Tohru Hirotsu; Yoji Nagayama; Hiroyuki Fujii, all of Mie, Japan

[73] Assignee: Central Glass Company Limited, Ube, Japan

[21] Appl. No.: 856,405

[22] Filed: Mar. 23, 1992

[30] Foreign Application Priority Data

Mar. 28, 1991 [JP] Japan ..... 3-019480[U]

[51] Int. Cl.[5] ..... H01Q 1/32

[52] U.S. Cl. ..... 343/713; 343/906; 439/578

[58] Field of Search ..... 343/711, 712, 713, 704, 343/906; 439/578, 585, 63, 98, 99; 174/75 C

[56] References Cited

U.S. PATENT DOCUMENTS

| | | | |
|---|---|---|---|
| 4,222,056 | 9/1980 | Graeser et al. | 343/906 |
| 4,721,964 | 1/1988 | Sato et al. | 343/713 |
| 5,097,270 | 3/1992 | Lindenmeier et al. | 343/713 |
| 5,145,409 | 9/1992 | Sato et al. | 439/585 |

FOREIGN PATENT DOCUMENTS

| | | | |
|---|---|---|---|
| 51-16677 | 5/1976 | Japan . | |
| 61-210705 | 9/1986 | Japan . | |
| 62-31203 | 2/1987 | Japan | 343/713 |
| 01-39876 | 5/1990 | Japan | 439/63 |
| 01-38872 | 6/1991 | Japan | 439/63 |
| 4-5708 | 1/1992 | Japan . | |
| 2180695 | 4/1987 | United Kingdom | 343/713 |

*Primary Examiner*—Michael C. Wimer
*Assistant Examiner*—Tan Ho
*Attorney, Agent, or Firm*—Keck, Mahin & Cate

[57] ABSTRACT

An antenna attached to a window glass for transmitting and receiving ultrashort waves includes a primary antenna having a first feed point which is electrically connected therewith, a secondary antenna having a second feed point which is electrically connected therewith. A feeder is a coaxial cable having inner and outer conductors, an insulator disposed therebetween, and an outer cover covering the outer conductor. A first terminal has a first base portion which is electrically connected to the first feed point, and a supporting portion for supporting thereon the inner conductor of the feeder so as to achieve an electrical connection between the first terminal and the inner conductor. A second terminal has a second base portion which is electrically connected to the second feed point, a first holding portion for holding the outer cover of the feeder, and a second holding portion for holding the outer conductor of the feeder so as to achieve an electrical connection between the second terminal and the outer conductor.

10 Claims, 3 Drawing Sheets

STRUCTURE FOR CONNECTING WINDOW GLASS ANTENNA WITH FEEDER

BACKGROUND OF THE INVENTION

1. Field of the Invention

The present invention relates to a structure for connecting a window glass antenna with a feeder, and more particularly to a structure for respectively connecting primary and secondary antennas with an inner conductor of a coaxial cable serving as the feeder and with an outer conductor of the same.

2. Description of the Prior Art

There are some proposals of providing an antenna for transmission and reception of ultrashort waves on an automobile or a building window glass. For example, U.S. Pat. No. 4,721,964 discloses a vehicular window glass antenna system which has one feeding point connected to an inner conductor of a coaxial cable is grounded, through a lead such as a polyvinyl chloride wire, to a part of a vehicular body serving as a grounded conductor, the part being located near the feeding point. However, this type of antenna has the following drawbacks.

The outer conductor is not directly connected to the part of the vehicular body, but to the same through the lead. Therefore, the assembly work becomes complicated due to the installation of the lead. Furthermore, due to the provision of the lead, there is provided a certain inevitable transmission loss, thereby lowering reception gain.

JP-B (Utility Model) 51-16677 discloses a vehicular window glass antenna which is installed on a laminated glass. The laminated glass has two overlapped glass plates interposing therebetween an interlayer and an antenna. One of the glass plates has a through opening for fully receiving therein a first terminal connected to the antenna. The first terminal is detachably connectable with a second terminal of a feeder. However, this type of antenna has the following drawback.

For installing the first terminal, it is necessary to drill the glass plate. This makes the assembly complicated and lowers strength of the laminated glass. Furthermore, this type of antenna can not be installed on a single glass plate.

JP-A (Patent) 61-210705 discloses a space diversity reception system installed in an automobile. The system includes a plurality of antennas spaced from each other with a certain distance therebetween for minimizing the effects of fading. However, this system has the following drawback.

Each antenna is connected to a coaxial cable through two terminals. Thus, by increasing the number of terminals, the assembly work becomes more complicated and the external appearance of the system becomes worse.

JP-A (Utility Model) 4-5708 discloses a structure for connecting primary and secondary antennas with an inner conductor of a coaxial cable and with an outer conductor of the same through first and second terminals, respectively. The first terminal has a bent portion defining a space for tightly holding therein the inner conductor. The second terminal has a supporting portion which is semi-cylindrical in shape, and on which the outer conductor is supported. However, this connecting structure has the following drawbacks.

Because the second terminal has only one portion for supporting the coaxial cable, the coaxial cable can not be supported by the second terminal with a sufficient strength. Because an upper half portion of an end portion of the outer conductor is exposed, upon soldering the outer conductor to the second terminal by a soldering iron, the outer conductor tends to be overheated by a direct abutment with the soldering iron. This overheat tends to damage an insulator disposed between the inner and outer conductors.

SUMMARY OF THE INVENTION

It is therefore an object of the present invention to provide an improved structure for connecting primary and secondary antennas with a feeder, which structure is simple in construction, and which can sufficiently tightly hold the feeder and transmit and receive ultrashort waves with sufficiently high gains.

It is another object of the present invention to provide an improved structure for connecting primary and secondary antennas with a feeder, which structure allows the feeder not to be damaged by heat upon soldering an outer conductor of a coaxial cable.

According to the present invention, there is provided an antenna attached to a window glass for transmitting and receiving ultrashort waves, the antenna including: a primary antenna having a first feed point which is electrically connected therewith; a secondary antenna having a second feed point which is electrically connected therewith; a feeder which is a coaxial cable having inner and outer conductors, an insulator disposed therebetween, and an outer cover covering the outer conductor; a first terminal having a first base portion which is electrically connected to the first feed point, and a supporting portion for supporting thereon the inner conductor of the feeder so as to achieve an electrical connection between the first terminal and the inner conductor; and a second terminal having a second base portion which is electrically connected to the second feed point, a first holding portion for holding the outer cover of the feeder, and a second holding portion for holding the outer conductor of the feeder so as to achieve an electrical connection between the second terminal and the outer conductor.

DESCRIPTION OF THE PREFERRED EMBODIMENTS

Figure 1:
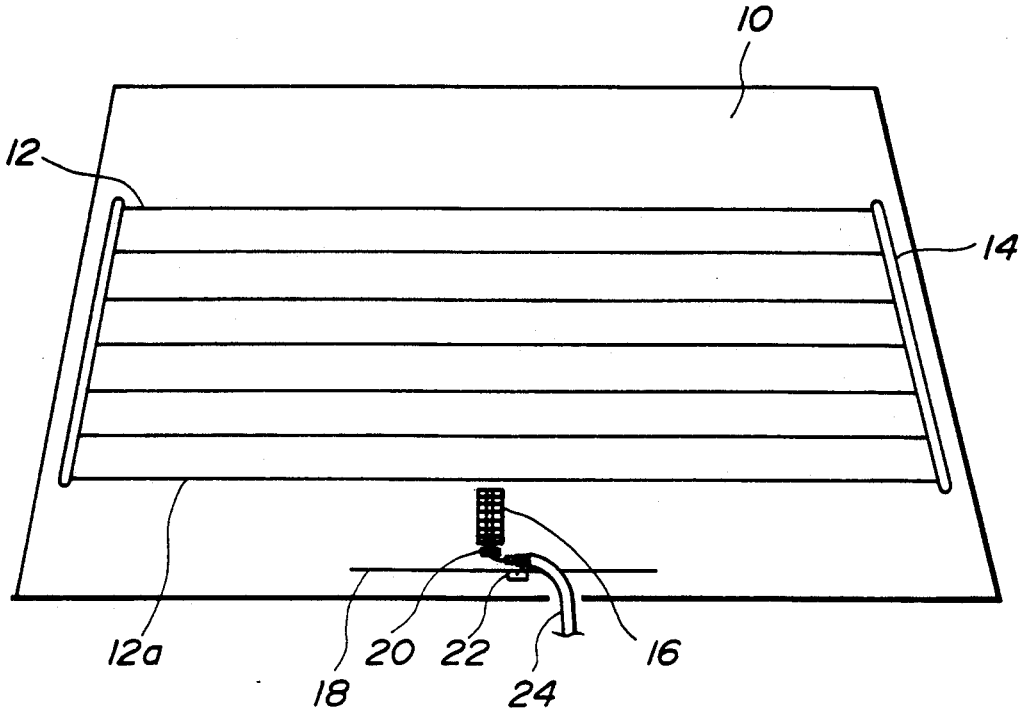
FIG. 1 is a plan view of an automobile rear window glass provided with primary and secondary antennas which are connected with a coaxial cable in accordance with the present invention.

FIG. 1 shows an automobile rear window glass 10 in which the present invention is embodied in a preferred manner. A single glass plate is used as the window glass 10. However, if desired, a laminated glass may be used. An array of defogging heater strips 12 is disposed on the inboard surface of the window glass 10 so as to leave an open space between the lower edge of the window glass 10 and the lowermost heater strip 12a. The heater strips 12 extend horizontally and connect with a pair of bus bars 14.

Using the open space below the heater strips 12 an antenna is disposed on the inboard surface of the window glass 10. Essentially the antenna is a combination of a primary antenna 16 and a secondary antenna 18. The primary antenna 16 is made up of a plurality of wire-like conductive strips and is connected to a first feed point 20. The secondary antenna 18 which extends horizontally is a single conductive strip having some width, and it is spaced from the primary antenna 16 and connected to a second feed point 22.

Usually the elements of the primary and secondary antennas 16 and 18 and the first and second feed points 20 and 22 as well as the heater strips 12 and the bus bars 14 are formed by printing a conductive paste onto the glass surface and, after drying, baking the window glass 10 with the printed paste thereon.

A coaxial cable 24 is used to connect the antenna to a transmitter-receiver (not shown) installed in the automobile.

Figure 2:
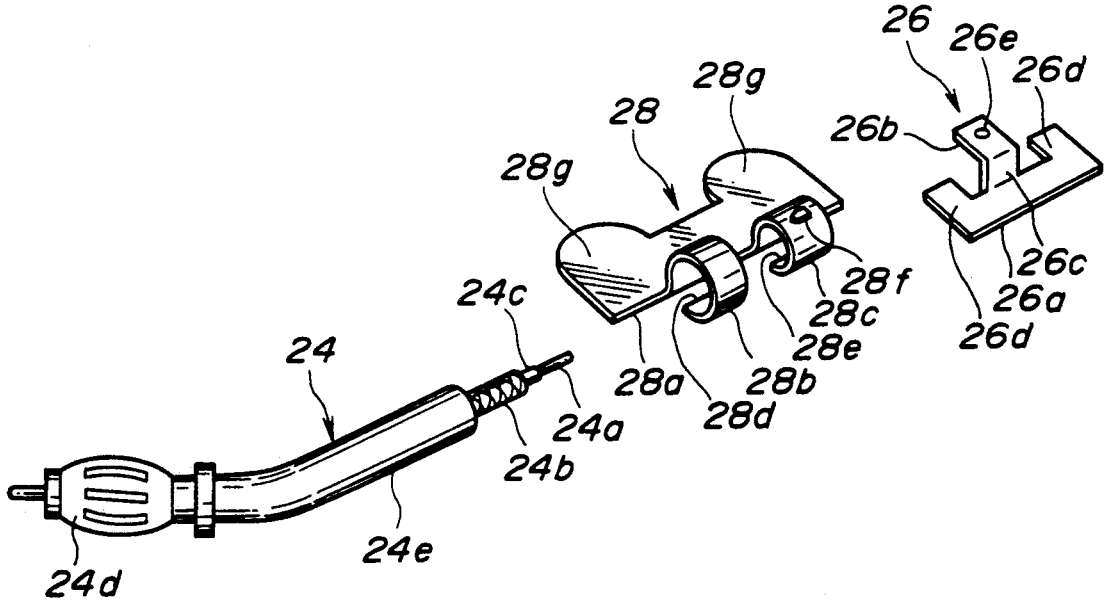
FIG. 2 is a perspective and enlarged view showing the coaxial cable and first and second terminals according to the present invention.

As is seen from FIG. 2, the coaxial cable 24 has an inner conductor (core) 24a and a tubular outer conductor 24b with an insulator 24c between the two conductors 24a and 24b. the coaxial cable 24 which is, for example, 200–300 mm in length has one end at which the inner and outer conductors 24a and 24b are exposed, and the other end which is formed with a connector 24d. First and second terminals 26 and 28 are used to connect the primary and secondary antennas 16 and 18, through the first and second feeding points 20 and 22, with the inner and outer conductors 24a and 24b of the coaxial cable 24, respectively. The first and second terminals 26 and 28 are of metal plates made of, for example, an alloy which contains copper and is plated with tin.

The first terminal 26 comprises a base portion 26a which is generally C-shaped, a supporting portion 26b which is arranged substantially parallel to the base portion 26a, and a connecting portion 26c for uniting the supporting portion 26b with the base portion 26a. The base portion 26a comprises two rectangular portions 26d which are opposed to each other and which have solder (not shown) adhered to the bottom surface thereof. The supporting portion 26b has solder 26e adhered to the upper surface thereof.

The second terminal 28 comprises a base portion 28a, and larger and smaller hollow cylidrical portions 28b and 28c extending from an edge of the base portion 28a. The larger and smaller cylindrical portions 28b and 28c are shaped so as to define mouth portions 28d and 28e, respectively. The cylindrical portions 28b and 28c are made flexible and sized so as to tightly hold an outer cover 24e and the outer conductor 24b of the coaxial cable 24, respectively. That is, upon thrusting the coaxial cable 24 into the cylindrical portions 28b and 28c, the mouth portions 28d and 28e are expanded so as to allow the coaxial cable 24 to be tightly held by the cylindrical portions 28b and 28c. The smaller cylindrical portion 28c has a through opening (not shown), and a certain amount of solder 28f is adhered to the smaller cylindrical portion 28c so as to close or fill up the through opening. The base portion 28a comprises two opposed portions 28g which have solder (not shown) adhered to the bottom surface thereof.

Assembly will be described in the following.

Figure 3:
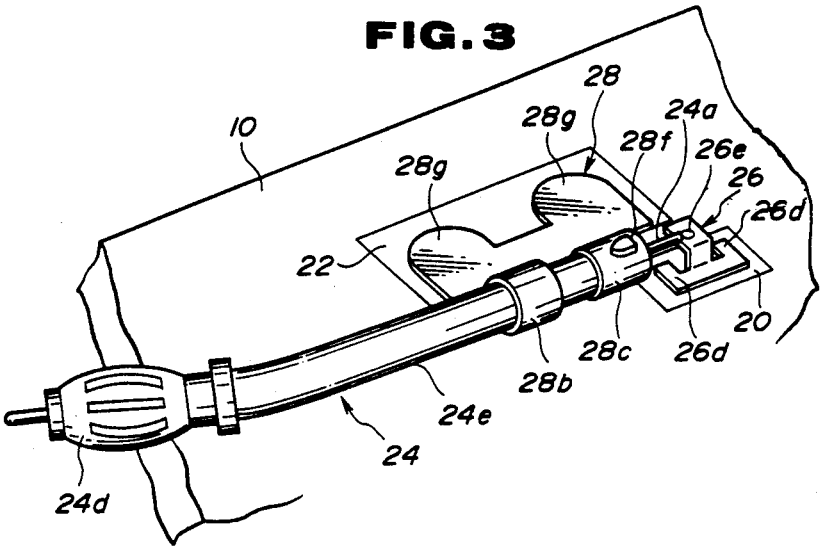
FIG. 3 is a view similar to FIG. 2, but showing the coaxial cable and the first and second terminals which are assembled on the window glass.

First, as is seen from FIGS. 2 and 3, the first terminal 26 is soldered to the first feeding point 20 connected to the primary antenna 16 by applying hot air to the rectangular portions 26d of the first terminal 26 so as to melt the solder adhered to the bottom surface of the rectangular portions 26d. Then, the coaxial cable 24 is thrust into the cylindrical portions 28b and 28c of the second terminal 28, such that the mouth portions 28d and 28e are expanded and such that the outer cover 24e and the outer conductor 24b of the coaxial cable 24 are respectively tightly held by the larger and smaller cylindrical portions 28b and 28c. Then, a heated soldering iron (not shown) is brought into abutment with the solder adhered to the smaller cylindrical portion 28c so as to achieve soldering between the outer conductor 24b and the smaller cylindrical portion 28c. However, if desired, this soldering can be omitted to achieve an electrical connection therebetween. Then, the second terminal 28 is placed on the second feeding point 22 connected to the secondary antenna 18, such that an end portion of the inner conductor 24a of the coaxial cable 24 is placed on the supporting portion 26b of the first terminal 26 and is in abutment with the solder adhered to the upper surface of the supporting portion 26b. Then, the second terminal 28 is soldered to the second feeding point 22 in the same manner as the first terminal 26 is. Then, the inner conductor 24a is soldered to the supporting portion 26b. Then, the window glass 10 equipped with the antenna which is connected with the coaxial cable 24 is installed on an automobile. Then, the coaxial cable 24 is connected, through the connector 24d thereof, to another coaxial cable (not shown) which is connected to a transmitter-receiver (not shown) installed in the automobile. With this, the primary antenna 16 is connected through the inner conductor 24a of the coaxial cable 24 to the transmitter-receiver, the secondary antenna 18 is grounded through the outer conductor 24b of the coaxial cable 24 to the chassis of the transmitter-receiver.

In the above-mentioned assembly, the first terminal 26 is soldered to the first feeding point 20 before connecting the coaxial cable 24 with the first terminal 26. However, if desired, the coaxial cable 24 can be connected to the first and second terminals 26 and 28, and then the terminals 26 and 28 can be respectively soldered to the first and second feeding points 20 and 22.

As is mentioned hereinabove, the base portion 26a of the first terminal 26 comprises two rectangular portions 26d. However, if desired, these portions 26d may take other shapes besides rectangular shape, for example, as will be shown in FIGS. 4–6.

Figure 4:
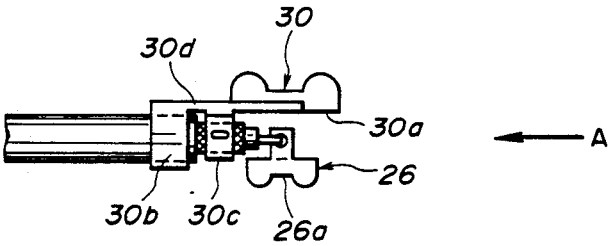
FIGS. 4 to 6 are plan views showing three different modifications of the second terminal shown in FIG. 3.

FIG. 4 shows a first modification of the second terminal 28 shown in FIGS. 2 and 3. Designated by numeral 30 is a second terminal of this modification. The second terminal 30 comprises a base portion 30a, larger and smaller cylindrical portions 30b and 30c, and a connecting portion 30d for uniting the base portion 30a with the cylindrical portions 30b and 30c, the connecting portion 30d being arranged substantially perpendicular to the base portion 30a. By the provision of the connecting portion 30d, the base portion 30a is positioned away from the cylindrical portions 30b and 30c such that the base portion 30a is positioned adjacent and opposite to the base portion 26a of the first terminal 26.

Figure 5:
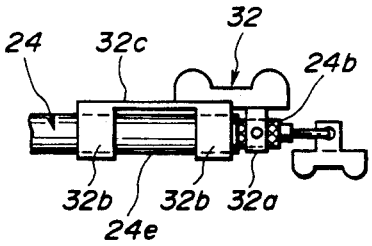

FIG. 5 shows a second modification of the second terminal 28 shown in FIGS. 2 and 3. Designated by numeral 32 is a second terminal of this modification. The second terminal 32 comprises a smaller cylindrical portion 32*a* for holding outer conductor 24*b* of the coaxial cable 24, two larger cylindrical portions 32*b* for holding the outer cover 24*e* of the same, and a connecting portion 32*c* for uniting the larger cylindrical portions 32*b* with each other. With this additional larger cylindrical portion 32*b*, the coaxial cable 24 is more tightly held by the second terminal 32.

Figure 6:
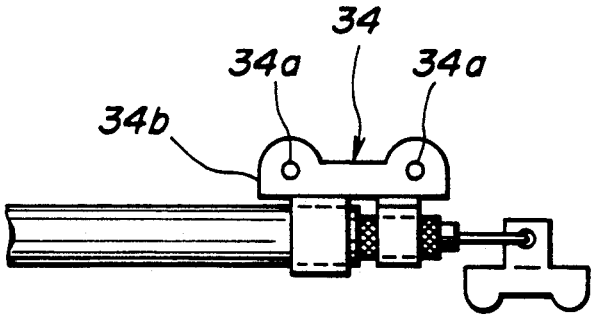

FIG. 6 shows a third modification of the second terminal 28 shown in FIGS. 2 and 3. Designated by numeral 34 is a second terminal of this modification. The second terminal 34 has two through holes 34*a* at its base portion 34*b*. By the provision of the through holes 34*a*, time necessary for soldering the second terminal 34 can be shortened because heat is rapidly transmitted through the through holes 34*a* to the solder adhered to the bottom surface of the base portion 34*b* of the second terminal 34.

Figure 7:
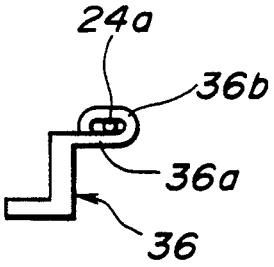
FIGS. 7 and 8 are schematic and elevational side views showing two different modifications of the first terminal shown in FIG. 4 and an inner conductor of the coaxial cable, the side views corresponding to an imaginary view of the first terminal which is taken along the arrow "A" of FIG. 4.

FIG. 7 shows a first modification of the first terminal 26 shown in FIGS. 2 and 3. Designated by numeral 36 is a first terminal of this modification. The first terminal 36 comprises a supporting portion 36*a* which is formed with a bent portion 36*b*. The bent portion 36*b* is made flexible and sized so as to tightly hold therein the inner conductor 24*a* of the coaxial cable 24. Thus, an electrical connection between the inner conductor 24*a* and the bent portion 36*b* can be achieved by thrusting the inner conductor 24*a* thereinto. However, if desired, after thrusting the inner conductor 24*a* thereinto, it may be soldered to the bent portion 36*b* to strengthen the connection therebetween.

Figure 8:
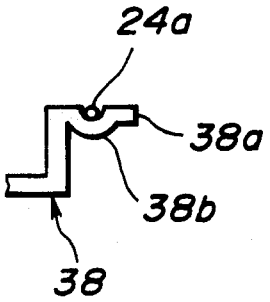

FIG. 8 shows a second modification of the first terminal 26 shown in FIGS. 2 and 3. Designated by numeral 38 is a first terminal of this modification. The first terminal 38 comprises a supporting portion 38*a* which has a concavity 38*b* for receiving therein the inner conductor 24*a* of the coaxial cable 24. The concavity 38*b* is generally semi-cylindrical in shape. By the provision of the concavity 38*b*, the inner conductor 24*a* is assuredly supported by the supporting portion 38*a*.

As is mentioned hereinabove, the present invention is embodied in the automobile rear window glass. However, if desired, it may be embodied in an automobile front or side window glass, or a building window glass, too.

The advantages of the present invention will be described in the following.

According to the present invention, the first and second terminals can be made simple in construction and compact in size. Since the outer cover and the outer conductor of the coaxial cable are respectively held by the larger and smaller cylindrical portions of the second terminal by only thrusting the coaxial cable into the cylindrical portions, an assembly is made simple and the coaxial cable is sufficiently tightly held by the second terminal.

According to the present invention, the primary antenna 16 is connected with the inner conductor 24*a* of the coaxial cable 24 and the secondary antenna 18 with the outer conductor 24*b*, whereby the window glass antenna becomes an ungrounded antenna. This manner of connection contributes to impedance matching between the antenna and the coaxial cable 24, which is an unbalanced feeder system, and consequently produces the effect of reducing loss of the antenna and enhancing the transmission and reception gains of the antenna.

According to the present invention, upon soldering the outer conductor of the coaxial cable to the smaller cylindrical portion of the second terminal, the soldering iron is not brought into a direct abutment with the outer conductor. With this, overheat of the outer conductor and damage to the insulator can be prevented.

What is claimed is:

1. An antenna attached to a window glass for transmitting and receiving ultrashort waves, the antenna comprising:

a primary antenna having a first feed point which is electrically connected therewith;

a secondary antenna having a second feed point which is electrically connected therewith;

a feeder which is a coaxial cable having inner and outer conductors, an insulator disposed therebetween, and an outer cover covering the outer conductor;

a first terminal having a first base portion soldered to the first feed point, a supporting portion for soldering thereto the inner conductor of said feeder so as to achieve an electrical connection between said first terminal and the inner conductor, and a first connecting portion for uniting the supporting portion with the first base portion; and a second terminal having a second base portion soldered to the second feed point, a first holding portion for holding the outer cover of said feeder, and a second holding portion for holding the outer conductor of said feeder so as to achieve an electrical connection between said second terminal and the outer conductor, the first and second holding portions of said second terminal being hollow and substantially cylindrical in shape and having means for respectively defining mouth portions, the mouth portions being expanded, upon thrusting said feeder into the first and second holding portions, such that the outer cover and the outer conductor are tightly held by the first and second holding portions, the second holding portion having means for defining therein a through opening and solder adhered thereto for filling up the through opening, wherein, after melting the solder, an electrical connection between the second holding portion and the outer conductor is achieved.

2. An antenna according to claim 1, wherein the supporting portion of said first terminal is arranged substantially parallel to the first base portion.

3. An antenna according to claim 1, wherein the supporting portion of said first terminal is flat in shape.

4. An antenna according to claim 1, wherein the supporting portion is formed with a bent portion defining a space which is sized so as to receive therein the inner conductor of said feeder.

5. An antenna according to claim 1, wherein the supporting portion is formed with a concavity for receiving therein the inner conductor.

6. An antenna according to claim 1, wherein the first holding portion is larger than the second holding portion in size.

7. An antenna according to claim 1, wherein the first and second holding portions extend from an edge of the second base portion.

8. An antenna according to claim 1, wherein said second terminal has a second connecting portion for uniting the first and second holding portions with the second base portion, such that the second base portion is positioned adjacent and opposite to the first base portion.

9. An antenna according to claim 1, wherein said second terminal has another second holding portion for holding the outer cover of said feeder so as to tightly hold said feeder.

10. An antenna according to claim 1, wherein the second base portion has another through opening so as to allow a solder adhered to the bottom surface of the base portion to melt rapidly.

* * * * *